United States Patent [19]

Shaw et al.

[11] Patent Number: 4,708,258

[45] Date of Patent: Nov. 24, 1987

[54] SALVAGE DRUM

[75] Inventors: Mark D. Shaw; J. Tad Heyman; Laurence M. Bierce, all of Jacksonville, Fla.

[73] Assignee: Bondico, Inc., Jacksonville, Fla.

[21] Appl. No.: 21,714

[22] Filed: Mar. 4, 1987

[51] Int. Cl.[4] ..... B65D 41/04

[52] U.S. Cl. ..... 220/288; 220/284; 220/1 T

[58] Field of Search ..... 220/1 T, 94 B, 284, 220/288

[56] References Cited

U.S. PATENT DOCUMENTS

| | | | |
|---|---|---|---|
| 3,438,538 | 4/1969 | Peters | 220/288 |
| 4,014,452 | 3/1977 | Gaher | 220/288 |
| 4,453,647 | 6/1984 | Neat | 220/288 |
| 4,558,796 | 12/1985 | Jaicks | 220/1 T |
| 4,666,054 | 5/1987 | Jaicks | 220/1 T |

*Primary Examiner*—George T. Hall
*Attorney, Agent, or Firm*—Wigman & Cohen

[57] ABSTRACT

A molded polyethylene salvage drum for containing hazardous wastes has a container having a solid side wall and a lid having a circular double-walled body. The container has a top portion provided on its exterior surface with male threads, an enlarged portion adjacent the threads, and a lower side wall portion adjacent the enlarged portion. An annular shoulder is formed on the container between the portion of enlarged diameter and the lower side wall. The lid has a skirt depending from the body of the lid. The interior surface of the skirt is provided with female threads mating with the male threads of the container. Castellations project upwardly from the lid body around the periphery thereof. The lid is molded so as to provide a plurality of kiss-off sections, in which the two walls of the body are molded together during rotational molding of the lid. The skirt of the lid terminates at its lower end in an outwardly extending lip with the outer diameter of the lip equal to the outer diameter of the enlarged diameter portion of the container. A gasket is provided in a circular recess in the lid for sealing engagement with the top edge of the container.

18 Claims, 7 Drawing Figures

SALVAGE DRUM

BACKGROUND OF THE INVENTION

The present invention relates to a salvage drum and more particularly to a polyethylene salvage drum for use in containing hazardous materials.

Polyethylene salvage drums for use in containing hazardous materials and in overpacking other drums containing hazardous materials are known in the art. Such drum-type containers must be corrosion resistant, should combine mechanical strength with light weight, and must be sufficiently strong at all points of construction so as to provide a safe container for the hazardous materials without leaking, despite the rough handling such containers must undergo during transportion and handling. For use in the United States, such containers must be approved by the U.S. Department of Transportation (DOT) which requires that the containers undergo rigorous testing. In particular, DOT testing requires dropping of a container, generally filled with water, from a specified height onto a concrete slab. The angle at which the container is dropped onto the concrete slab is varied. Accordingly, hazardous material salvage drums must be extremely strong and well constructed. In addition, the drum containers should be stackable, both when loaded and when unloaded. Furthermore, convenient means for threading on and off the lid of a threaded container for nuclear or hazardous materials should be provided.

A search of the prior art failed any to uncover any prior art references which disclose the polyethelene salvage drum of the present invention. A number of patents were uncovered which disclose plastic drums and containers used for a variety of purposes. The following is a listing of the patents uncovered during the aforementioned search:

| U.S. Pat. No. | Patentee | Issue Year |
|---|---|---|
| 3,438,538 | Peters | 1969 |
| 3,529,743 | Ehrbar et al | 1970 |
| 3,942,677 | Hagen et al | 1976 |
| 3,998,355 | Galer | 1976 |
| 4,399,926 | Eidels-Dubovay | 1983 |
| 4,453,647 | Neat | 1984 |
| 4,558,796 | Jaicks | 1985 |

SUMMARY AND OBJECTS OF THE INVENTION

In view of the limitations and shortcomings of the prior art containers, as well as other disadvantages not specifically mentioned above, it should be apparent that there still exists a need in the art for a polyethylene salvage drum which is mechanically strong, affordably priced, and suitable for containing harzardous materials in a leak-tight manner. In addition, there is a need in the art of hazardous waste disposal for a polyethylene salvage drum with a threaded lid which is easy to tighten or loosen, is nestable and light in weight, has an internal volume large enough to receive all DOT and non-DOT specification drums of 55 gallons or smaller, and which has no metal parts, so that it is capable of being completely incinerated. It is, therefore, a primary objective of this invention to fullfil this need by providing a polyethylene hazardous material salvage drum which exhibits great mechanical strength and resistance to leakage and satisfies all the foregoing requirements for containing harzardous materials.

More particularly, it is an object of this invention to provide a hazardous material salvage drum which is made by rotationally molding the container and lid from a linear low or medium density polyethylene.

It is another object of this invention to provide a hazardous material salvage drum which is nestable and stackable in both the filled and unfilled conditions.

Another object of this invention to provide a hazardous material salvage drum which has means for containment of gasses which may build up within the drum.

Yet another object of this invention is to provide a polyethylene salvage drum with a male thread and a lid with a female thread for threadably securing the lid to the drum in a leak-tight manner such that a build-up of internal gas pressure will cause enhancement of the leak-tight seal between the drum and lid.

Another object of the invention is to provide a double wall, rotationally molded polyethylene drum lid which has sufficient mechanical strength to meet handling requirements in a leak-free manner.

Still another object of this invention is to provide a hazardous material salvage drum which is provided with means to permit handling by a fork-lift or the like, yet is designed so as to make it impossible for a handler of the drum to insert the fork of the fork-lift or other lifting device between the lid and the drum container.

Briefly described, the aforementioned objects are accomplished according to the invention by providing a rotationally molded polyethylene salvage drum which has a container with a solid, slightly outwardly tapered lower side wall portion, an upper side wall portion which is provided with male threads and an intermediate, enlarged diameter, substantially cylindrical portion adjacent the male threads which forms a shoulder above the lower side wall portion of the container. The container is closed by a rotationally molded lid having a circular, double-walled body and a double-walled skirt depending from the periphery of the circular body, the interior circumferential surface of the skirt being provided with female threads mating with the male threads of the container. The outside diameter of the skirt of the lid has a diameter substantially equal to or slightly less than the outside diameter of the enlarged diameter portion of the side wall of the container and the lowermost edge of the lid skirt is disposed in close proximity to the enlarged side wall portion of the container when in sealed relation thereof. The inner diameter of the threaded portion of the container is greater than the outer diameter of the lower side wall portion of the container to allow nesting of the unfilled containers.

Castellations are provided on the lid and project upwardly from the body of the lid about the periphery thereof. A plurality of "kiss-off" sections are provided in the double-walled lid, wherein the two walls of the body are molded together into a single wall at discrete points during the molding process for the purpose of strengthening the lid. The double-walled skirt of the lid terminates at its lower end in an outwardly extending annular lip, the outer diameter of which is preferably no greater than the outer diameter of the enlarged diameter portion of the container. The lip provides a shoulder for receiving and supporting a metal band for further securement of the lid to the container in the event of an anticipated build-up of internal pressure in the drum.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF A PREFERRED EMBODIMENT

Figure 1:
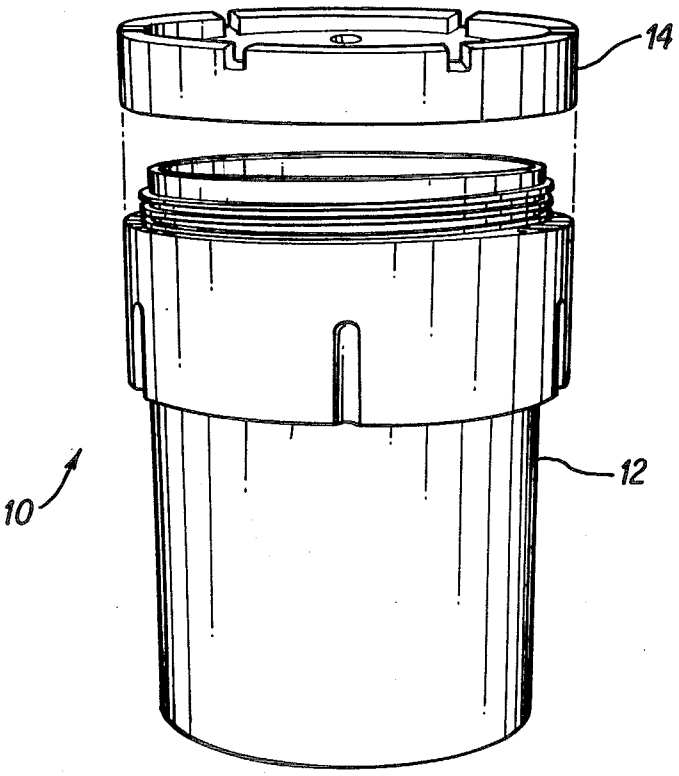
FIG. 1 is a perspective view of the hazardous material salvage drum in accordance with the invention, showing both the container and the lid of the drum.

Referring now in detail to the drawings wherein like parts are designated by like reference numerals throughout, there is illustrated in perspective in FIG. 1 a molded polyethylene salvage drum 10 for containing hazardous material and made in accordance with the invention. Drum 10 has two parts, a container 12 and a lid 14.

Figure 2:
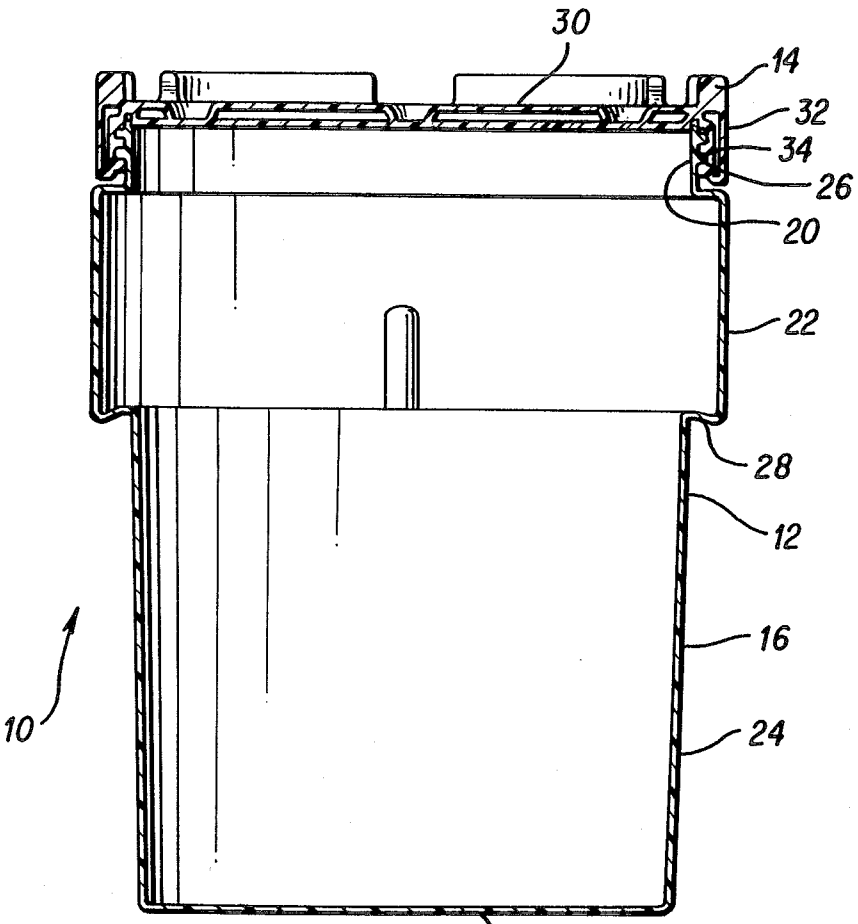
FIG. 2 is a sectional view of the hazardous material salvage drum in accordance with the invention, with the lid being threaded onto the container.
Figure 3:
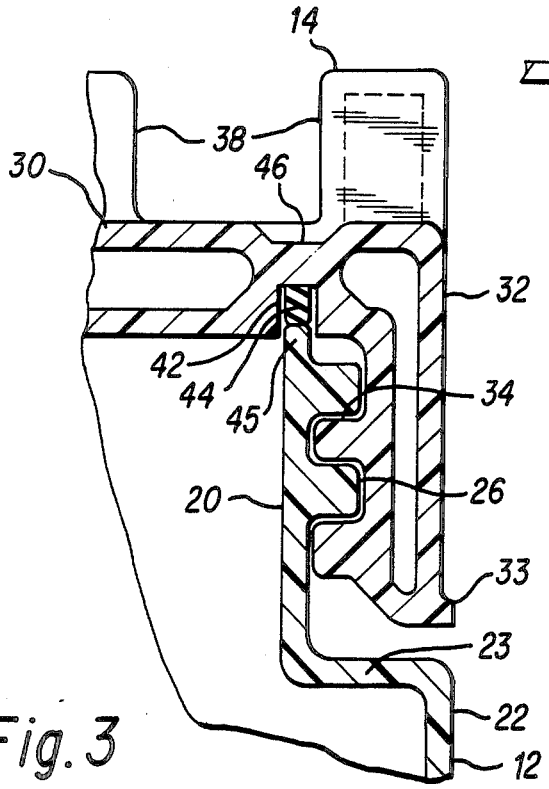
FIG. 3 is a detailed sectional view of a portion of the drum in accordance with the invention, illustrating the lid threaded onto the container.

Referring now to FIGS. 2 and 3, with further reference to FIG. 1, container 12 is rotationally molded, preferably of a linear, low-density polyethylene, with a solid, slightly outwardly tapered side wall 16 and a circular bottom wall 18. Side wall 16 is divided into three portions, an upper or top side wall portion 20, an enlarged side wall portion 22 adjacent the upper portion 20, and a lower side wall portion 24 adjacent enlarged portion 22 and having a diameter smaller than those of the enlarged portion 22 and the upper portion 20. Upper portion 20 is provided on its exterior circumferential surface with a plurality of male threads 26. An annular shoulder 28 is formed on container 12, between enlarged portion 22 and lower portion 24.

Lid 14 is rotationally molded with a double-walled body 30, which provides structural rigidity and strength to lid 14. Depending from double-walled body 30 is a double-walled annular skirt 32. On the inside circumferential surface of skirt 32 there are formed a plurality of female threads 34. Female threads 34 of lid 14 mate with and threadably engage male threads 26 formed on the outer surface of the upper portion 20 of container 12. By using male threads on the drum and female threads on the drum lid, pressure which builds up inside container 10 will tend to tighten the threaded connection in a leak-proof manner.

Figure 7:
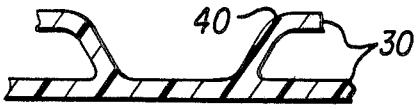
FIG. 7 is a detail view of a typical "kiss-off" section of the lid, taken along line VII—VII of FIG. 6.
Figure 6:
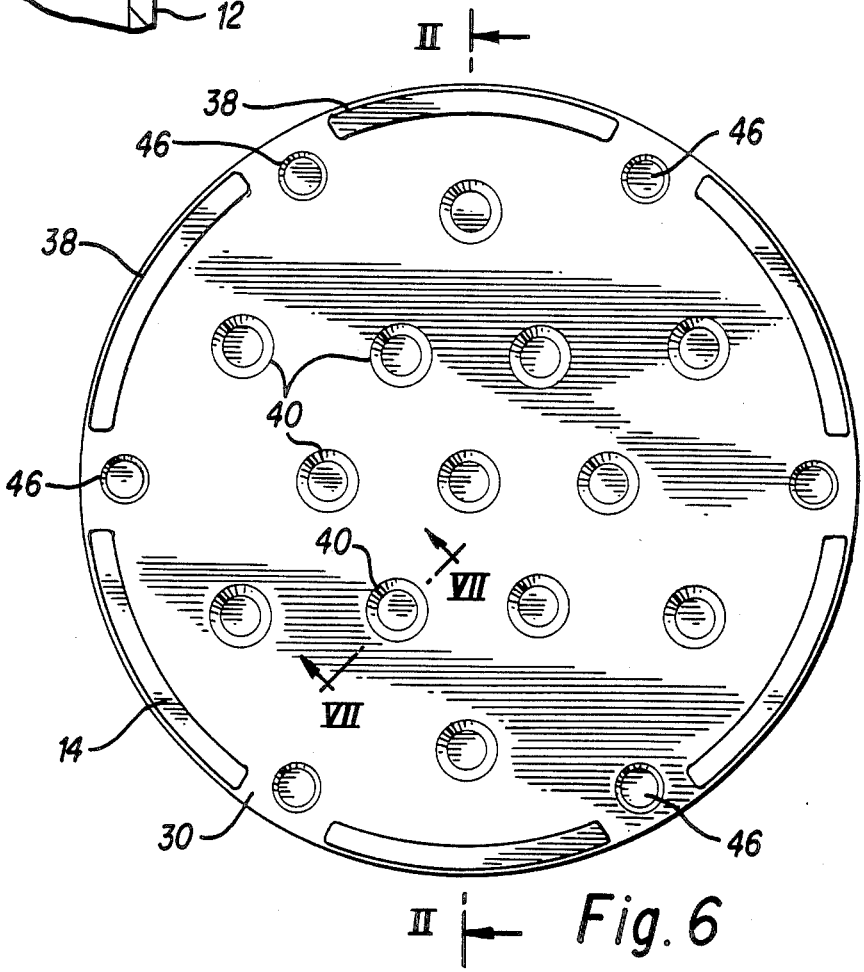
FIG. 6 is a top view of the lid of the hazardous material salvage drum of the invention.

Referring now to FIGS. 6 and 7 with further reference to FIG. 2, double-walled body 30 of lid 14 is rotationally molded with a plurality of "kiss-off" portions 40. "Kiss-off" portions 40 are formed as frusto-conical recesses or cavities when the two walls of double-walled body 30 are brought together to form a single wall at discrete locations on the lid during the process of rotationally molding lid 14. "Kiss-off" portions 40 provide additional rigidity for the double-walled body 30 of lid 14.

As shown in FIGS. 1–3 and FIG. 6, lid 14 is provided with a plurality of castellations 38 which project upwardly from the upper surface of body 30 and which are arranged in equi-angular spaced relation around the periphery of body 30. The gaps between castellations 38 are made sufficiently large to accommodate a beam, such as a 2″×4″ wooden beam, to provide a means for easy tightening and loosening of lid 14 on container 12. The castellations 38 of a first container are arranged on the periphery of lid 14 and are formed with an inner diameter large enough to accommodate the lower portion 24 of a second container 12, and thereby allow stacking of the second container on the first container when lid 14 is threaded into place on the first container. By reason of the double wall structure of the body 30 and "kiss-off" portions, the lid 14 is sufficiently strong to accommodate a plurality of filled or unfilled drums stacked one on top of the other.

Referring now to FIG. 3, annular groove 42 is formed on the underside of double-walled body 30 of lid 14. Groove 42 extends completely around the lid adjacent to the circumference thereof for receipt of a gasket 44. Groove 42 is so dimensioned as to allow gasket 44 to be sealingly compressed in position by the uppermost edge 45 of upper side wall portion 20 when threads 26 of container 12 are mated with threads 34 of lid 14. In addition, a plurality of "kiss-off" portions 46 having shallower frusto-conical recesses than those of "kiss-off" portions 40 are provided in the double-walled body 30 of lid 14 aligned with the gaps to provide strength in the area of the gaps between castellations 38 and to also provide back-up strength for groove 42 in the lid.

Skirt 32 terminates in an outwardly extending circumferential lip 33. Lip 33 serves the purpose of providing a guide and shoulder support for a conventional metal band (not shown) which may be placed around skirt 32 to circumferentially tighten lid 14 on top portion 20 of container 12. When lid 14 is threaded onto container 12 in sealed relation thereto, the lip 33 is disposed in close proximity to the upper shoulder 23 of enlarged portion 22 and has an outer diameter approximately equal to the outer diameter of enlarged portion 22 in order to prevent a handler of the drum from lifting the drum by its lid or inserting the fork of a fork-lift or other tool between lid 14 and container 12.

Figure 4:
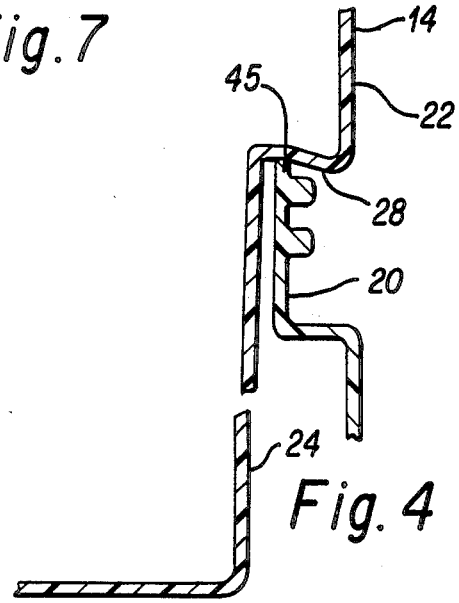
FIG. 4 is a cross-sectional view of a portion of two containers stacked one inside the other, in accordance with the invention.
Figure 5:
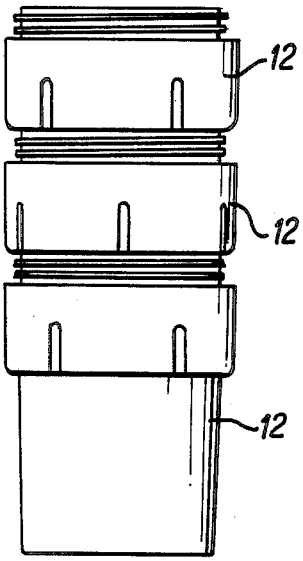
FIG. 5 is a side elevation view showing three containers stacked one inside the other, in accordance with the invention.

Referring now to FIGS. 4 and 5, the nesting of unfilled containers 12 is illustrated. As shown in FIG. 4, the inside diameter of upper side wall portion 20 of container 14 is greater than the outer diameter of lower side wall portion 24 of the container. This allows nesting of several containers as illustrated in FIG. 5. Annular tapered shoulder 28 formed between enlarged portion 22 and lower portion 24 defines a conical surface which provides a self-centering annular groove for the upper edge 45 of another container which nests in the groove (FIG. 4).

In use, the container 10 of the invention is first filled by placing a drum containing hazardous material in container 12 (overpacking). Lid 14 is then placed into position on container 12 so that the female threads 34 of lid 14 engage the male threads 26 on container 12. The lid is then rotated, thereby threading the lid 14 onto container 12. A 2″×4″ beam may be placed in oppositely disposed gaps formed between castellations 38 to aid in rotation of lid 14. Lid 14 is tightened on container 12 to the position as shown in FIG. 3 in which the upper edge 45 of upper portion 20 of the container compresses gasket 44 in recess 42. If pressure builds up in the container, the internal pressure tightens the threaded connection of the male threads on container 12 and the female threads on lid 14.

Several filled containers can be stacked one on top of the other with the bottom wall 18 of one container nesting within the castellations 38 provided on the lid of another drum. When it is desired to remove the hazardous material from the drum 10, a 2"×4" beam is inserted in a pair of oppositely disposed gaps between castellations 38 to aid in unthreading and removing lid 14 from container 12. The hazardous materials may then be removed from the drum 10. When containers 12 are not in use they may be nested together, as illustrated in FIG. 5.

The container 12 and lid 14 are preferably rotationally molded of a linear low or medium density polyethylene, such as, for example, Union Carbide's GPEP 805 linear low density polyethylene, UV inhibited. A nominal wall thickness of about 0.20 inches is preferred for both the lid and container. A typical "kiss-off" portion 40 has a diameter at the bottom of the recess of about 1.5 inches and at the top of the recess about 2.5 inches.

Although only preferred emobidments are specifically illustrated and described herein, it will be appreciated that many modifications and variations of the present invention are possible in light of the above teachings and within the purview of the appended claims without departing from the spirit and intended scope of the invention.

We claim:

1. A salvage drum for containing hazardous wastes comprising:

a container having a side wall and a circular bottom wall, said side wall having an exterior surface, an interior surface, an upper side wall portion, a lower side wall portion, and an enlarged diameter side wall portion intermediate the upper and lower side wall portions, the exterior surface of the upper side wall portion being provided with male threads, said container having an annular shoulder formed between the lower side wall portion and the enlarged diameter side wall portion; and a lid having a double-walled body and a double-walled annular skirt depending from the double-walled body, said skirt having an interior circumferential surface and an exterior circumferential surface, the interior circumferential surface of said skirt being provided with female threads for mating with the male threads of said container.

2. The salvage drum of claim 1 wherein the outside diameter of the skirt of said lid has a diameter equal to or less than the outside diameter of the enlarged diameter side wall portion of the container.

3. The salvage drum of claim 2 wherein the inner diameter of the upper side wall portion of said container is greater than the outer diameter of the lower side wall portion of said container.

4. The salvage drum of claim 1 further including an annular recess disposed on the interior of said lid body adjacent said skirt, said upper side wall portion of said container having an annular edge and a gasket disposed in said recess and compressible by said annular edge for sealing said lid to said container.

5. The salvage drum of claim 1 wherein said container and lid are molded of polyethylene.

6. The salvage drum of claim 5 wherein said polyethylene is a linear low or medium density polyethylene.

7. The salvage drum of claim 1 wherein said lid comprises a plurality of upstanding castellations having a plurality of gaps therebetween disposed about the periphery of said lid body, said gaps being disposed diametrically opposite one another whereby a turning means can be disposed in a pair of said oppositely disposed gaps for turning said lid to threadably engage or disengage the male and female threads.

8. The salvage drum of claim 1 including an outwardly extending circumferential lip on the lowermost edge of said skirt.

9. The salvage drum of claim 1, including a plurality of stiffening means in the body of said lid for stiffening said lid.

10. The salvage drum of claim 9, wherein said stiffening means comprise a plurality of frusto-conical recesses in the surface of the body of said lid at which the double walls of said body are molded together as a single wall.

11. The salvage drum of claim 1 wherein said annular shoulder is inclined upwardly toward the axis of said container.

12. The salvage drum of claim 11 wherein the upper side wall of said container has an annular edge engagable with the annular shoulder of a further container when said further container is disposed in nesting relation in said container.

13. The salvage drum of claim 10, wherein one of said recesses is disposed adjacent each of said gaps.

14. The salvage drum of claim 1, wherein said lower side wall portion is tapered outwardly from said bottom wall to said annular shoulder.

15. A molded polyethylene salvage drum for hazardous waste materials comprising:

a container having a solid side wall and a circular bottom wall, said solid side wall having an exterior surface, an interior surface, a top end and a bottom end, the exterior surface of the top end of said side wall being provided with male threads; and a lid having a circular, double-walled body and a double-walled skirt depending from the circular body, said skirt having an interior surface and an exterior surface, the interior surface of said skirt being provided with female threads mating with the male threads of said container.

16. The salvage drum of claim 15 including means for stiffening the double-walled lid body comprising a plurality of kiss-off portions, wherein the two walls of the body are molded together during molding of said lid to form a single wall at said kiss-off portions.

17. The salvage drum of claim 16 wherein the double-walled skirt of the lid terminates at its lower end in an outwardly extending lip, said container side wall having an enlarged diameter portion in the area below the threads, said lip having an outer diameter substantially equal to the outer diameter of said enlarged diameter portion of said container.

18. A molded polyethylene salvage drum for hazardous waste materials comprising;

a container having a circular solid bottom wall and a solid side wall tapered outwardly from said circular bottom wall, said side wall having an exterior surface, an interior surface, an upper side wall portion terminating in a top edge and a lower side wall portion, the exterior surface of the upper side wall portion being provided with male threads, the side wall being provided with an enlarged diameter portion intermediate said upper and lower side wall portions, said container having an annular shoulder formed between the enlarged diameter portion of the side wall and the lower side wall portion;

a lid having a circular, double-walled body and a double-walled skirt depending from the circular body, said skirt having an interior surface and an exterior surface, the interior surface of said skirt being provided with female threads mating with the male threads of said container, castellations projecting upwardly from the periphery of said lid body, a plurality of kiss-off sections molded in said circular body, wherein the two walls of the lid body are molded together at said kiss-off sections during molding of said lid, the double-walled skirt of the lid terminating at its lower end in an outwardly extending lip, said enlarged diameter portion of the container side wall having an outer diameter substantially equal to the outer diameter of the lip, the inner diameter of the upper side wall portion of said container being greater than the outer diameter of the lower side wall portion of said container.

* * * * *

US004708258B1

REEXAMINATION CERTIFICATE (2318th)

United States Patent [19]

[11] B1 4,708,258

Shaw et al.

[45] Certificate Issued Jun. 21, 1994

[54] SALVAGE DRUM

[75] Inventors: Mark D. Shaw; J. Tad Heyman; Laurence M. Bierce, all of Jacksonville, Fla.

[73] Assignee: Essef Corporation, Chardon, Ohio

Reexamination Request:
No. 90/003,006, Mar. 24, 1993

Reexamination Certificate for:

| | |
|---|---|
| Patent No.: | 4,708,258 |
| Issued: | Nov. 24, 1987 |
| Appl. No.: | 21,714 |
| Filed: | Mar. 4, 1987 |

[51] Int. Cl.[5] ..... B65D 41/04

[52] U.S. Cl. ..... 220/288; 220/284; 220/908

[58] Field of Search ..... 220/288, 908, 284, 23.83, 220/23.6, 521, 215, 304, 669, 675; 215/302; 206/505, 507, 508, 515, 519

[56] References Cited

U.S. PATENT DOCUMENTS

| | | | |
|---|---|---|---|
| 2,563,352 | 8/1951 | Morse | 220/215 X |
| 2,633,264 | 3/1953 | Dinsmore et al. | 220/425 |
| 3,520,441 | 7/1970 | Fitzgerald | 206/519 X |
| 3,529,743 | 9/1970 | Ehrbar et al. . | |
| 3,648,888 | 3/1972 | Cheldze | 206/519 |
| 3,942,677 | 3/1976 | Hagen et al. . | |
| 3,949,877 | 4/1976 | Santoni | 206/519 |
| 4,156,491 | 5/1979 | Lyon | 215/302 |
| 4,399,926 | 8/1983 | Eidels-Dubovoy . | |
| 4,817,801 | 4/1989 | Schwaikert | 206/519 |

FOREIGN PATENT DOCUMENTS

| | | | |
|---|---|---|---|
| 509453 | 7/1939 | United Kingdom | 206/519 |

OTHER PUBLICATIONS

Antec '82 The 40th Annual Technical Conference and Exhibition of the Society of Plastics Engineers, "Plastics–Meeting Challenges of the Future," Blow Molding Highly Irregular Parts with Moving Mold Sections, D. L. Peters, pp. 711–713, Society of Plastics Engineers, 1982.

*Basic Principles of Rotational Molding*, Edited by Paul F. Bruins; pp. 16–19, 41, 51–52 and 170–173; Gordon and Breach, Science Publishers, 1971.

*Technical Information on Martlex ®Polyolefin Plastics*, Phillips Petroleum Company, 1969.

*Primary Examiner*—Allan N. Shoap

[57] ABSTRACT

A molded polyethylene salvage drum for containing hazardous wastes has a container having a solid side wall and a lid having a circular double-walled body. The container has a top portion provided on its exterior surface with male threads, an enlarged portion adjacent the threads, and a lower side wall portion adjacent the enlarged portion. An annular shoulder is formed on the container between the portion of enlarged diameter and the lower side wall. The lid has a skirt depending from the body of the lid. The interior surface of the skirt is provided with female threads mating with the male threads of the container. Castellations project upwardly from the lid body around the periphery thereof. The lid is molded so as to provide a plurality of kiss-off sections, in which the two walls of the body are molded together during rotational molding of the lid. The skirt of the lid terminates at its lower end in an outwardly extending lip with the outer diameter of the lip equal to the outer diameter of the enlarged diameter portion of the container. A gasket is provided in a circular recess in the lid for sealing engagement with the top edge of the container.

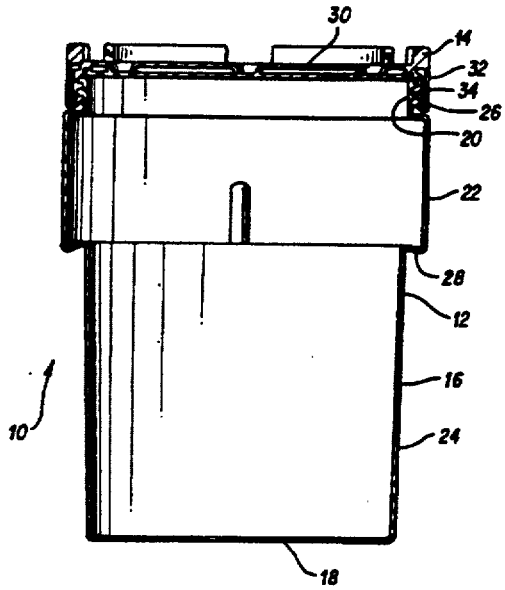

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 13 and 16 are cancelled.

Claims 1, 3, 15, 17 and 18 are determined to be patentable as amended.

Claims 2, 4–12 and 14, dependent on an amended claim, are determined to be patentable.

New claims 19–26 and 27 are added and determined to be patentable.

1. A *molded polyethylene* salvage drum for containing hazardous wastes comprising:

a container having a side wall and a circular bottom wall, said side wall having an exterior surface, an interior surface, an upper side wall portion, a lower side wall portion, and an enlarged diameter side wall portion *having a diameter greater than the diameters of the upper and lower side wall portions and being disposed* intermediate the upper and lower side wall portions, the exterior surface of the upper side wall portion being provided with male threads, said container having [an] *a first* annular shoulder formed between the lower side wall portion and the enlarged diameter side wall portion *and a second annular shoulder formed between the upper side wall portion and the enlarged diameter side wall portion, said enlarged diameter side wall portion having only a single wall with a substantially uniform diameter between said first and second annular shoulders*; and a lid having a double-walled body and a double-walled annular skirt depending from the double-walled body, said skirt having an interior circumferential surface and an exterior circumferential surface, the interior circumferential surface of said skirt being provided with female threads for mating with the male threads of said container.

3. The salvage drum of claim 2 wherein the inner diameter of the upper side wall portion of said container is greater than the outer diameter of the lower side wall portion of said container *at said first annular shoulder.*

15. A molded polyethylene salvage drum for hazardous waste materials comprising:

a container having a solid side wall and a circular bottom wall, said solid side wall having an exterior surface, an interior surface, a top end and a bottom end, the exterior surface of the top end of said side wall being provided with male threads, *said container side wall having an enlarged diameter portion in the area below the threads and above the bottom end of the container, said enlarged diameter portion having only a single wall with a substantially uniform diameter, being defined by upper and lower shoulders and having a diameter greater than the diameters of the top and bottom ends of the container, the inner diameter of the top end of the container being greater than the outer diameter of the bottom end of the container immediately below the lower shoulder*; and a lid having a circular, double-walled body and a double-walled skirt depending from the circular body, said skirt having an interior surface and an exterior surface, the interior surface of said skirt being provided with female threads mating with the male threads of said container, *means for stiffening the double-walled lid body comprising a plurality of kiss-off portions, wherein the two walls of the body are molded together during molding of said lid to form a single wall at said kiss-off portions.*

17. The salvage drum of claim [16] *15* wherein the double-walled skirt of the lid terminates at its lower end in an outwardly extending lip, [said container side wall having an enlarged diameter portion in the area below the threads,] said lip having an outer diameter substantially equal to the outer diameter of said enlarged diameter portion of said container.

18. A molded polyethylene salvage drum for hazardous waste materials comprising:

a container having a circular solid bottom wall and a solid side wall tapered outwardly from said circular bottom wall, said side wall having an exterior surface, an interior surface, an upper side wall portion terminating in a top edge and a lower side wall portion, the exterior surface of the upper side wall-portion being provided with male threads, the side wall being provided with an enlarged diameter portion *having only a single wall with a substantially uniform diameter greater than the diameters of the upper and lower side wall portions and being disposed* intermediate said upper and lower side wall portions, said container having an annular shoulder formed between the enlarged diameter portion of the side wall and the lower side wall portion;

a lid having a circular, double-walled body and a double-walled skirt depending from the circular body, said skirt having an interior surface and an exterior surface, the interior surface of said skirt being provided with female threads mating with the male threads of said container, castellations projecting upwardly from the periphery of said lid body, a plurality of kiss-off sections molded in said circular body, wherein the two walls of the lid body are molded together at said kiss-off sections during molding of said lid, the double-walled skirt of the lid terminating at its lower end in an outwardly extending lip, said enlarged diameter portion of the container side wall having an outer diameter substantially equal to the outer diameter of the lip, the inner diameter of the upper side wall portion of said container being greater than the outer diameter of the lower side wall portion of said container *at said annular shoulder.*

*19. A molded polyethylene salvage drum containing hazardous wastes comprising a container having a side wall and a circular bottom wall, said side wall having an exterior surface, an interior surface, an upper side wall portion having an upper annular edge, a lower side wall portion, and an enlarged diameter side wall portion having a diameter greater than the diameters of the upper and lower side wall portions and being disposed intermediate the upper*

*and lower side wall portions, the inner diameter of the upper side wall portion of said container being greater than the largest outer diameter of the lower side wall portion, the exterior surface of the upper side wall portion being provided with male threads, said container having a first annular shoulder formed between the lower side wall portion and the enlarged diameter side wall portion and a second annular shoulder formed between the upper side wall portion and the enlarged diameter side wall portion, said enlarged diameter portion having only a single wall with a substantially uniform diameter between said first and second annular shoulders, a lid having a double-walled body and a double-walled annular skirt depending from the double-walled body, said skirt having an interior circumferential surface and an exterior circumferential surface, the interior circumferential surface of said skirt being provided with female threads for mating with the male threads of said container.*

*20. The salvage drum of claim 19, wherein said lid comprises a plurality of upstanding castellations having a plurality of gaps therebetween disposed about the periphery of said lid body, said gaps being disposed opposite one another whereby a turning means can be disposed in a pair of said oppositely disposed gaps for turning said lid to threadably engage or disengage the male and female threads.*

*21. The salvage drum of claim 20, wherein an annular recess is disposed on the interior of said lid body adjacent said skirt.*

*22. The salvage drum of claim 21, wherein at least a portion of the two walls of the double-walled lid body are molded together as a single wall at said gaps and said annular recess.*

*23. The salvage drum of claim 19, wherein the inside diameter of said upper side wall portion of said container is radially spaced from the outside diameter of the lower side wall portion of a further container when said further container is disposed in nesting relationship in said container with the first annular shoulder of the further container resting upon the upper annular edge of the upper side wall portion of said container.*

*24. A salvage drum containing hazardous wastes comprising a container having a side wall and a circular bottom wall, said side wall having an exterior surface, an interior surface, an upper side wall portion having an upper annular edge, a lower side wall portion, and an enlarged diameter side wall portion intermediate the upper and lower side wall portions, the inner diameter of the upper side wall portions of said container being greater than the largest outer diameter of the lower side wall portion, the exterior surface of the upper side wall portion being provided with male threads, said container having an annular shoulder formed between the lower side wall portion and the enlarged diameter side wall portion, a lid having a double-walled body and a double-walled annular skirt depending from the double-walled body, said skirt having an interior circumferential surface and an exterior circumferential surface, the interior circumferential surface of said skirt being provided with female threads for mating with the male threads of said container, said lid further comprising a plurality of upstanding castellations having a plurality of gaps therebetween disposed about the periphery of said lid body, an annular gasket recess disposed on the interior or said lid body adjacent the interior circumferential surface of the skirt, at least a portion of the two walls of the double-walled lid body being molded together as a single wall at said gaps and said angular gasket recess.*

*25. The salvage drum of claim 24, wherein the diameter of the enlarged diameter side wall portion has a diameter greater than the diameters of the upper and lower side wall portions.*

*26. The salvage drum of claim 24, wherein the enlarged diameter portion has only a single wall with a substantially uniform diameter.*

*27. A salvage drum containing hazardous wastes comprising a container having a side wall and a circular bottom wall, said side wall having an exterior surface, an interior surface, an upper side wall portion having an upper annular edge, a lower side wall portion, and an enlarged diameter side wall portion having a diameter greater than the diameters of the upper and lower side wall portions and being disposed intermediate the upper and lower side wall portions, the inner diameter of the upper side wall portion of said container being greater than the largest outer diameter of the lower side wall portion, the exterior surface of the upper side wall portion being provided with male threads, said container having a first annular shoulder formed between the lower side wall portion and the enlarged diameter side wall portion and a second annular shoulder formed between the upper side wall portion and the enlarged diameter side wall portion, said enlarged diameter portion having a single wall with a substantially uniform diameter between said first and second annular shoulders, a lid having a double-walled body and a double-walled anular skirt depending from the double-walled body, said skirt having an interior circumferential surface and an exterior circumferential surface, the interior circumferential surface of said skirt being provided with female threads for mating with the male threads of said container, said lid comprising a plurality of upstanding castellations having a plurality of gaps therebetween disposed about the periphery of said lid body, at least a portion of the two walls of the double-walled lid body being molded together as a single wall at said gaps.*

* * * * *